US007108572B1

(12) United States Patent
Bennett

(10) Patent No.: US 7,108,572 B1
(45) Date of Patent: Sep. 19, 2006

(54) SAILBOARD WITH MULTIPLE SKEGS

(76) Inventor: Ronald D. Bennett, 3834 Murworth, Houston, TX (US) 77025

( * ) Notice: Subject to any disclaimer, the term of this patent is extended or adjusted under 35 U.S.C. 154(b) by 0 days.

(21) Appl. No.: 10/969,500

(22) Filed: Oct. 20, 2004

Related U.S. Application Data

(60) Provisional application No. 60/512,413, filed on Oct. 20, 2003.

(51) Int. Cl.
*B63B 1/00* (2006.01)

(52) U.S. Cl. ..... 441/79

(58) Field of Classification Search ..... 441/79; 114/39.15
See application file for complete search history.

(56) References Cited

U.S. PATENT DOCUMENTS 4,090,681 A 5/1978 Zimmer
4,805,546 A * 2/1989 Geller et al. ..... 114/132
4,949,919 A 8/1990 Wajnikonis
5,022,337 A 6/1991 Caldwell
5,038,698 A * 8/1991 Winner ..... 114/39.15
5,106,331 A * 4/1992 Lizarazu ..... 441/55
6,340,134 B1 1/2002 Meschino
2003/0124924 A1 * 7/2003 McCausland et al. ..... 441/79
2003/0166365 A1 * 9/2003 Redmon ..... 441/79

* cited by examiner

*Primary Examiner*—Stephen Avila
(74) *Attorney, Agent, or Firm*—Egbert Law Offices

(57) ABSTRACT

A sailboard has a pair of skegs extending downwardly from a bottom surface thereof generally adjacent a rear of the sailboard. The pair of fins extend in a vertical orientation parallel to a centerline of the sailboard. A retractable fin is mounted adjacent the rear of the sailboard. The sailboard has a mast base adjacent an aerodynamic center thereof. A tunnel area is formed at a bottom surface of the sailboard adjacent the rear of the sailboard between the pair of skegs.

8 Claims, 4 Drawing Sheets

SAILBOARD WITH MULTIPLE SKEGS

RELATED U.S. APPLICATIONS

The present application claims priority from U.S. Provisional Patent Application No. 60/512,413, filed on Oct. 20, 2003, and entitled "Sailboard with Multiple Skegs".

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to sailboards. More particularly, the present invention relates to sailboard having multiple skegs. Additionally, the present invention relates to sailboard having retractable fins mounted at a rear thereof. Furthermore, the present invention relates to sail boards having enhanced aerodynamic board lift and stability. The present invention additionally relates to sailboards having a tunnel area formed in an underside thereof.

BACKGROUND OF THE INVENTION

A sailboard is a modified surfboard having a single sail mounted on a mast that pivots on a ball joint. The rider of a sailboard stands on the top surface of the sailboard. The skeg on a sailboard is located close to the rear of the board. The skeg is a vertical structure, which acts as a lifting body to create lift and stability. The lift of the skeg works with the sail to enable the sailboard to go up wind. The skeg is also referred to as a fin. The sailboard evolved from sailing combined with surfing. The earliest sailboard started as a long board with a dagger board and a skeg much like a sailboat.

The sailboard evolved into a much shorter board with a single skeg in the back. No dagger board is necessary if the board is planing. Other advances have occur to affect the construction of sailboard, including sail size, which has increased form 7 sq. meters to 12.5 sq. meters. Consequently, the bigger sails require bigger skegs; thus, skeg size has increase from 38 cm to 85 cm. This ratio may be approximated by the ratio of the density of water to the density of air. The size of the skeg has increased until the skeg is now as large as prior art dagger boards. The width of the sailboard also increased to support the larger equipment. The single skeg model of sailboards has reached a point of diminishing returns such that the increase of power and lift from the larger sails and skegs is counterbalanced by increased drag and more expensive construction.

Certain prior art patents include descriptions of various efforts to reduce drag in aircraft and foils. U.S. Pat. No. 6,340,134, issued on Jan. 22, 2002 to Meschino describes a wing combination for drag reduction, aircraft including such a wing, and a method of reducing the drag of an existing aircraft. A supplementary wing is used to connect to the main wing of an aircraft to reduce drag. U.S. Pat. No. 5,022,337, issued on Jun. 11, 1991 to Caldwell teaches a lift producing device exhibiting low drag and reduced ventilation potential and method for producing the same. This invention discloses a lifting device for sailboats and sailboards, which have been shaped to reduce ventilation. U.S. Pat. No. 4,949,919, issued on Aug. 21, 1990 to Wajnikonis discloses a foil with high lift and low drag coefficients. The foil disclosed in this patent aims to improve hydrofoil efficiency by reducing the vortex area of the tip of the foil. Furthermore, U.S. Pat. No. 4,090,681, issued on May 23, 1978 to Zimmer teaches an airplane with two superposed wings. As a biplane, the invention uses a rhombic shape frame of the wings to reduce drag.

Sailboards have not used multiple high aspect ratio skegs to reduce induced drag in the past. All race (formula) boards currently use a single skeg. Dual and triple skegs have been used to increase stability and turning ability. The dual skegs used in the past were not large enough to provide good upwind performance. These dual skegs, as used in the past, were low aspect ratio fins. The distance between the fins was not wide enough to reduce the interference drag to acceptable levels. These previous fins designs were not mounted parallel to each other and to the centerline of the sailboard. In certain circumstances, thruster fins have been used to improve jibbing performance. These thruster fins are small fins located close to the outer rail of the sailboard.

In the past, the tail width of all board designs has been too narrow to support the use of dual fins. Current formula board designs are only now approaching a width of 70 centimeters at the tail.

Dagger board have been used since the beginning of sailboarding. All prior art dagger boards have been located in the center of the board between the mast base and the skeg. These dagger boards were intended to work with the skeg.

Previous sailboard designs were too long to aerodynamically stable. It is intended to make the board designs extremely long for high speed sailing in order to minimize aerodynamic lift. The prior art sailboards have not used tunnels formed on the underside thereof to improve aerodynamic stability and lift. Prior art sailboards have a flipped up nose which causes turbulence and increase drag.

It is an object of the present invention to provide a sailboard that enables a formula-type board to be competitive at the low end of the wind range and to increase board speed.

It is another object of the present invention to provide a sailboard which increases competitiveness of the sailboard by planing in light wind and increasing sub-planing performance.

It is an another object of the present invention to provide a sailboard having reduced board drag.

It is a further object of the present invention to provide a sailboard which reduces fin drag to allow higher pointing angles when sailing upwind and faster board speed and deeper pointing angles when sailing offwind.

It is a further object of the present invention to provide a sailboard with a rear-mounted dagger board which allows the sailboard to sail upwind in very light wind.

These and other objects and advantages of the present invention will become apparent from a reading of the attached specification and appended claims.

BRIEF SUMMARY OF THE INVENTION

The present invention is an apparatus comprising a sailboard and a pair of skegs (or fins) extending downwardly from the bottom surface of the sailboard generally adjacent the rear of the sailboard. This pair of skegs extends in a vertical orientation. The sailboard has a top surface for receiving human feet thereon and a bottom surface suitable for contacting a surface of a body of water.

In the present invention, the pair of skegs extend parallel to the centerline of the sailboard. This pair of skegs has a distance therebetween that is equal or greater than a span of each skeg. Each of the pair of skegs has an aspect ratio of greater than 7 (in the preferred embodiment of the present invention). Each of the pair of skegs is generally adjacent opposite sides of the sailboard.

In the present invention, a retractable fin is mounted adjacent to the rear of the sailboard. The retractable fin is retractably mounted so as to move between a first position generally perpendicular to the sailboard and a second position aligned with the sailboard. An arm is connected to the retractable fin adjacent a pivot point of the retractable fin. A movement of the arm will cause the retractable fin to retractably move between the first and second positions. In one embodiment of the present invention, the sailboard has a receptacle formed in the bottom surface thereof. The retractable fin is received in receptacle when retracted to the second position. In an alternative embodiment of the present invention, the retractable fin is retracted to a position extending outwardly of the rear of the sailboard when retracted to the second position. As used herein, the "retractable fin" is similar to a "dagger board" but does not require a traditional second fin to operate.

The sailboard of the present invention has a mast base on the top surface thereof. The sailboard has an aerodynamic center located at or slightly rearwardly of the mast base.

In one form of the present invention, the sailboard has a tunnel area formed in the bottom surface thereof adjacent the rear of the sailboard. This tunnel area is positioned between the pair of skegs. This tunnel area has sides tapering toward each other away from the rear of the sailboard. These sides define an angle of incidence with respect to the pair of skegs. The sides are respectively spaced by an equal distance from the pair of fins. In another form of the present invention, the sailboard has a single retractable fin and no skegs.

BRIEF DESCRIPTION OF THE VIEW OF THE DRAWINGS

DETAILED DESCRIPTION OF THE INVENTION

Figure 1:
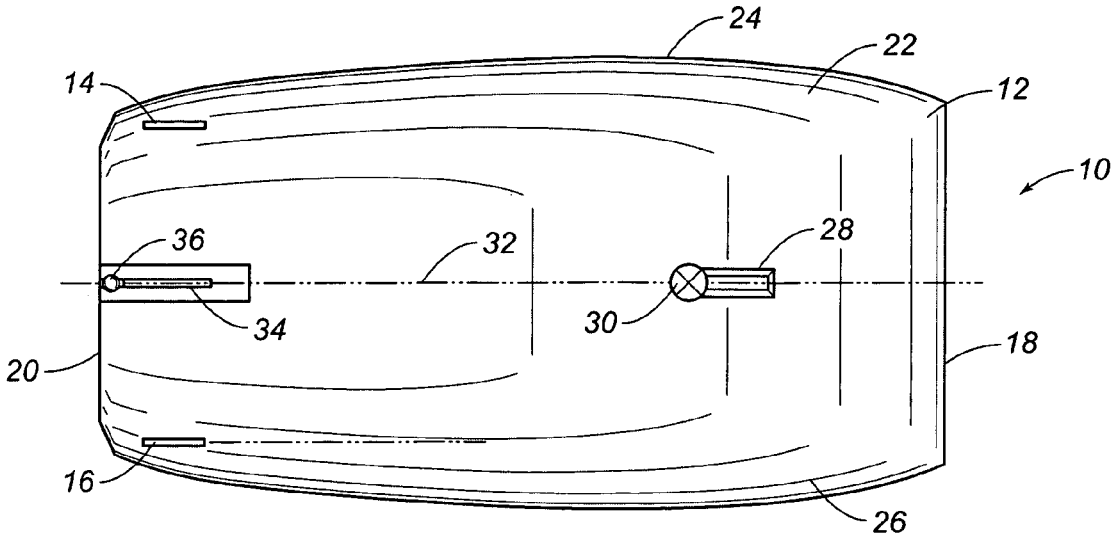
FIG. 1 is a plan view of the sailboard in accordance with the preferred embodiment of the present invention.

FIG. 1 illustrates the apparatus 10 of the present invention. The apparatus 10 includes a sailboard 12 having a pair of skegs 14 and 16 affixed thereto. The sailboard 12 has a front 18 and a rear 20. It can be seen that the sailboard 12 has the skegs 14 and 16 positioned generally adjacent to the rear 20. The sailboard 12 has a top surface 22 suitable for receiving human feet thereon (in the nature of existing sailboards). The bottom surface (not shown) will be suitable for contacting the surface of a body of water. The pair of skegs 14 and 16 will extend downwardly from this bottom surface adjacent to the rear 20 of the sailboard. The pair of skegs 14 and 16 will extend in a generally vertical direction. The fin 14 will be adjacent to the side 24 of sailboard 12. The fin 16 will be adjacent to the side 26 of sailboard 12. The top surface 22 of the sailboard 12 has a mast base 28 formed thereon. The aerodynamic center 30 of sailboard 12 will be positioned at or slightly rearwardly of the mast base 28.

In the preferred embodiment of the present invention, as shown in FIG. 1, the apparatus 10 has the pair of skegs 14 and 16 extending generally parallel to each other and parallel to a center line 32 (illustrated in broken line fashion) of the sailboard 12. The pair of skegs 14 and 16 will have a distance therebetween. This distance will be equal to or greater than a span of the pair of skegs 14 and 16. As will be described hereinafter, each of the pair of fins has an aspect ratio of greater than 7. The rear 20 of the sailboard 12 will have a width of greater than 70 centimeters. This width will be suitable for accommodating skegs that are sixty centimeters long.

As can seen in FIG. 1, a retractable fin 34 is mounted generally adjacent to the rear 20 of sailboard 12. An arm 36 will extending upwardly and outwardly of the retractable fin 34 so as to allow the user of the sailboard 12 to suitably manipulate the retractable fin 34 between an outwardly deployed and a retracted position.

Figure 2:
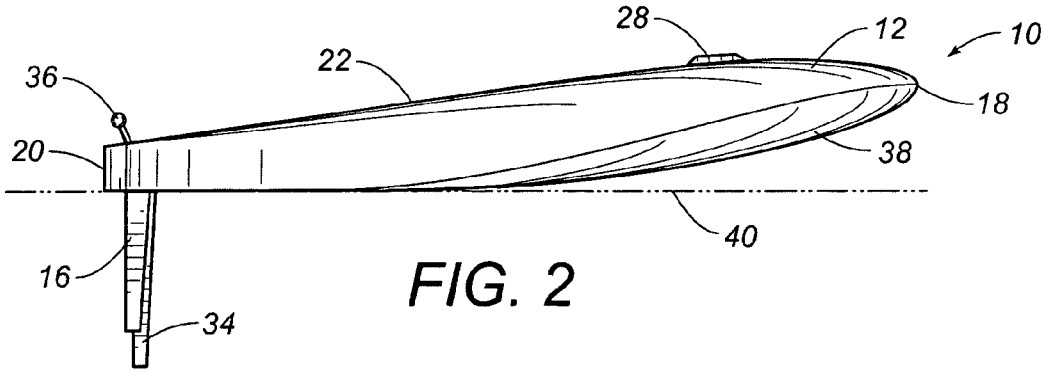
FIG. 2 is a side view of the sailboard in accordance of the preferred embodiment of the present invention.

As can be seen in FIG. 2, the bottom surface 38 of the sailboard 12 of apparatus 10 has a surface which can contact the surface 40 of a body of water. In normal use, the forward end 18 of the sailboard 12 will extend upwardly and outwardly above the surface 40 of the body of water. As such, the bottom surface 38 will not continuously contact the surface 40 of the body of water during normal use of the apparatus 10.

The fin 16 is illustrated as extending generally perpendicular to the bottom surface 38 of sailboard 12. Fin 16 will extend downwardly into the body of water. The fin 16 is generally adjacent to the rear 20 of the sailboard 12.

The retractable fin 34 will extend downwardly into the body of water. Arm 36 extends upwardly above the top surface 22 of the sailboard 12. The arm 36 will be positioned by manipulation by the foot of the user of the sailboard 12. The mast base 28 is located on the top surface 22 of sailboard 12.

Figure 3:
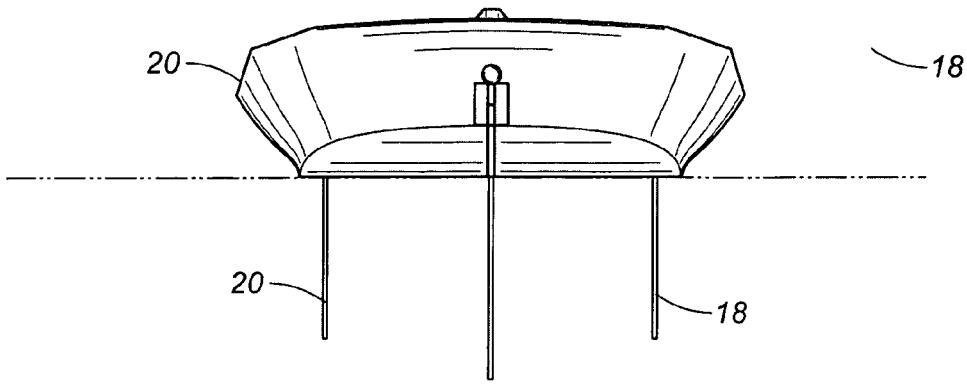
FIG. 3 is a rear view of the sailboard of the preferred embodiment of the present invention.

FIG. 3 illustrates a rear view of the apparatus 10 of the present invention. In this rear view, it can be seen how the skegs 14 and 16 are spaced from each other and generally parallel relationship to each other. The skegs 14 and 16 extend downwardly into the water 42 a desired distance. The skegs 14 and 16 are generally positioned adjacent to the sides 24 and 26, respectively, of the sailboard 12. The retractable fin 34 extends between the skegs 14 and 16 so as to have arm 36 extending upwardly above the top surface 22 of the sailboard 12. The mast base 28 is located on the top surface 22.

Figure 4:
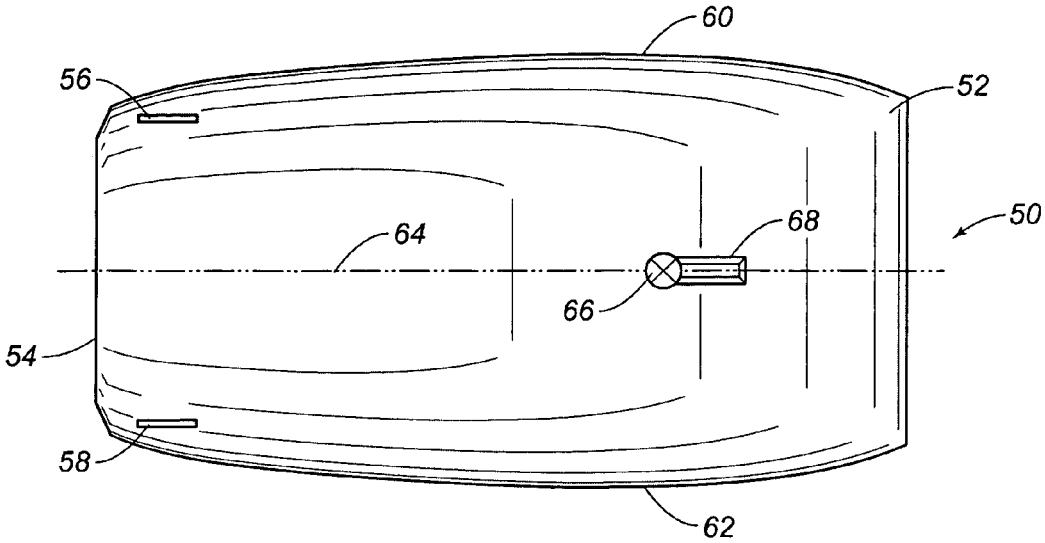
FIG. 4 is a plan view of alternative embodiment of the sailboard of the present invention.

FIG. 4 shows an alternative embodiment of the apparatus 50 of the present invention. The apparatus 50 includes sailboard 52 having a configuration similar as that of the sailboard 12 of FIG. 1. In this alternative embodiment of the present invention, there is no retractable fin located adjacent to the rear end 54 of the sailboard 52. It can be seen that fins 56 and 58 are generally positioned adjacent to the sides 60 and 62 of the sailboard 52 and spaced in parallel relationship to the centerline 64. The aerodynamic center 66 is located generally adjacent to or slightly rearwardly of the mast base 68.

Figure 5:
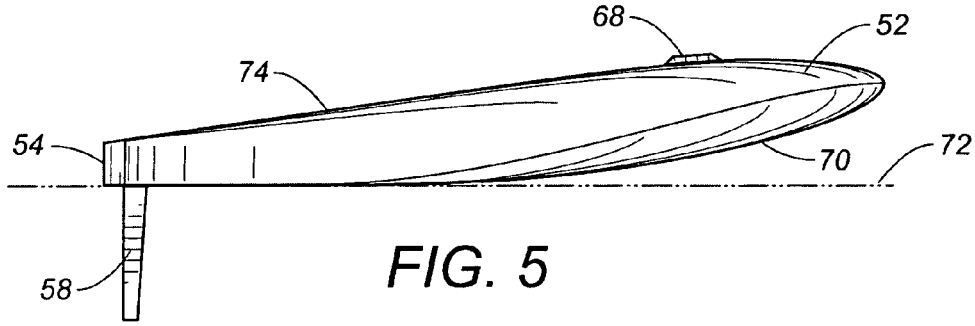
FIG. 5 is a side elevational view of the sailboard of this first alternative embodiment of the present invention.

In FIG. 5 it can be seen that the sailboard 52 has a bottom surface 70 contacting the surface 72 of the body of water. The mast base 68 is located on the top surface 74 of the sailboard 52. Fin 58 is illustrated as extending downwardly into the body of water generally adjacent to the rear 54 of the sailboard 52.

Figure 6:
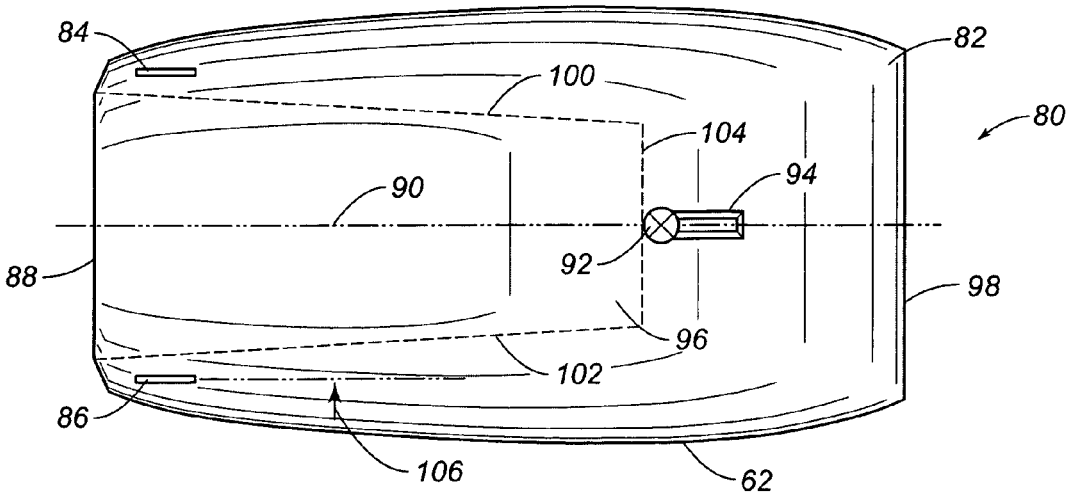
FIG. 6 is a plan view of a second alternative embodiment of the present invention.

FIG. 6 shows a second alternative embodiment of the apparatus 80 of the present invention. Apparatus 80 includes the sailboard 82 having a pair of fins 84 and 86 mounted generally adjacent to the rear 88 of sailboard 82. The pair of fins 84 and 86 are mounted in generally parallel relationship and equal distance from the centerline 90 of the sailboard 82. The aerodynamic center 92 of sailboard 82 is located at or slightly rearwardly of the mast base 94.

In this alternative embodiment of the apparatus 80, a tunnel area 96 is formed on the underside of the sailboard 82. The tunnel area 96 extends toward the front 98 of sailboard 82 from the rear 88. The tunnel area 96 has sides 100 and 102 which taper inwardly toward each other as the tunnel area 96 extends away from the rear 88. The tunnel area 96 has a forward end 104 which terminates adjacent to the aerodynamic center 92 of the sailboard 82. The rear end of the tunnel area 96 will open at the rear 88 of sailboard 82. The sides 100 and 102 are equally spaced from the fins 84 and 86. An angle of incidence 106 is defined between the fins 84 and 86 and the respective sides 100 and 102 of tunnel area 96. It should be noted that the tunnel area 96 can also be stepped to provide multiple planing surfaces. The tunnel area may have an angle of incidence with the fins or it may be parallel. The tunnel area 96 may be parallel toward the front of the board and have an angle toward the rear of the borad.

Figure 7:
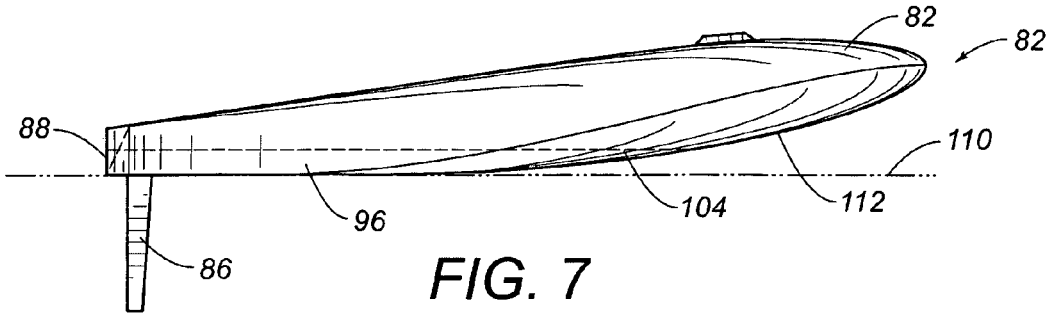
FIG. 7 is a side elevational view of the second alternative embodiment of the sailboard of the present invention.

FIG. 7 illustrates the alternative embodiment 80 on a body of water 110. As can be seen the bottom surface 112 of the sailboard 82 will reside on the surface of the body of water 110. Fin 86 will extend into the body of water 110 a desired distance. The tunnel area 96 will extend from the rear 88 of sailboard 82 so as to terminate along forward edge 104. The tunnel area 96 may be parallel to or at a slight angle to the surface of the body of water 110.

Figure 8:
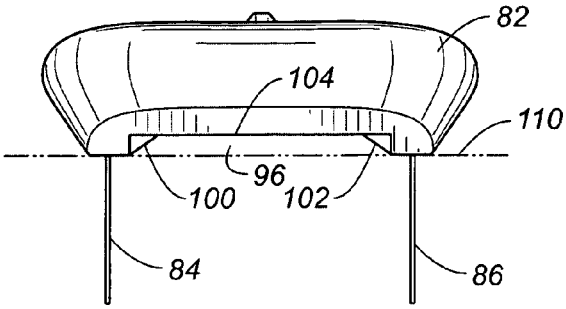
FIG. 8 is rear view of the second alternative embodiment of the sailboard of the present invention.

As can be seen in FIG. 8, the tunnel area 96 extends between the fins 84 and 86. The sides 100 and 102 of the tunnel area 96 slightly taper outwardly. The top 114 of the tunnel area 96 is arranged so as to be generally parallel or at a slight angle to the surface of the body of water 110.

Figure 9:
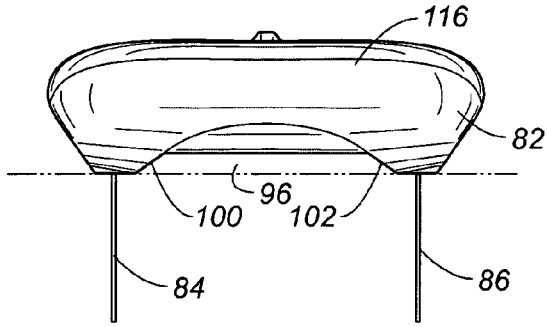
FIG. 9 is a front view of the second alternative embodiment of the sailboard of the present invention.

FIG. 9 illustrates the front 116 of the sailboard 82. As can be seen, the tunnel area 96 opens toward the forward edge 116 of the sailboard 82. The fins 84 and 86 are evenly spaced from the sides 100 and 102 of the tunnel area 96.

Figure 10:
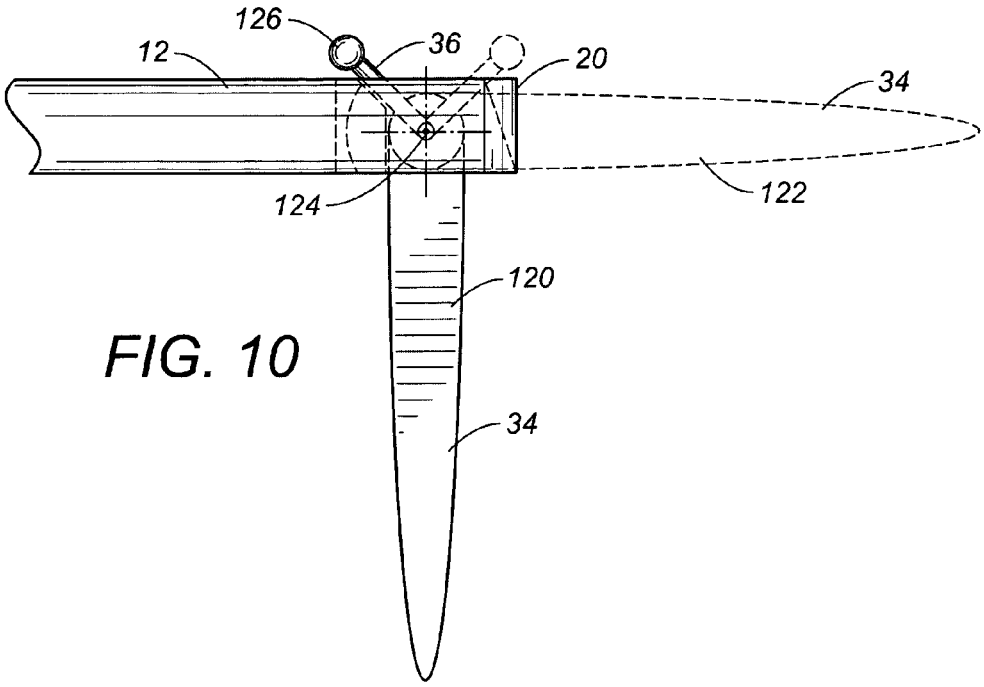
FIG. 10 is a side detail view of one of the embodiment of the retractable fin as used with the sailboard of present invention.

FIG. 10 particularly illustrates the manner in which the retractable fin 34 can be deployed or retracted relative to the sailboard 12. In FIG. 10 it can be seen that the retractable fin 34 is movable between a first position (illustrated by retractable fin 120) to a second position (illustrated by retractable fin 122). The retractable fin 34 is pivotally mounted at pivot point 124 adjacent to the rear 20 of sailboard 12. An arm 36 is connected to the retractable fin 34 at the pivot point 124. A knob 126 is affixed to the end of the arm opposite the pivot point 124. The user of the sailboard 52 can manipulate the retractable fin 34 by moving the knob 126 in one direction or another. The retractable fin 34 is in the first position 120 generally perpendicular to the sailboard 12. The second position 122 is deployed outwardly of the rear 20 of the sailboard 12 such that the retractable fin 34 is aligned with the sailboard 12.

Figure 11:
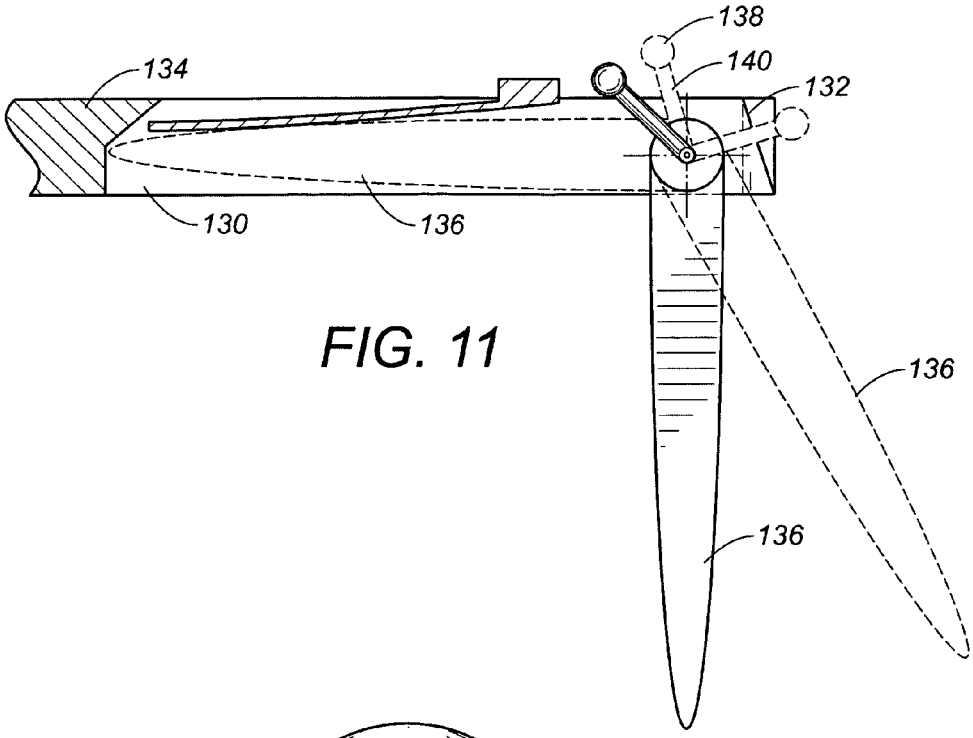
FIG. 11 is an alternative form of the retractable fin as used in the alternative form of the present invention.

FIG. 11 shows an alternative form of the retractable fin as used in the present invention. In FIG. 11, it can be seen that there is a receptacle 130 formed adjacent to the rear 132 of sailboard 134. The receptacle 130 provides an area whereby the retractable fin 136 can be received when deployed in its retracted position. The retractable fin 136 can be suitably moved outwardly by the manipulation of the knob 138 on arm 140 so as to move the retractable fin 136 in a generally perpendicular orientation to the sailboard 134. A further movement of the knob 138 can move the retractable fin 136 slightly angularly outwardly at a generally obtuse angle with respect to the sailboard 134.

Figure 12:
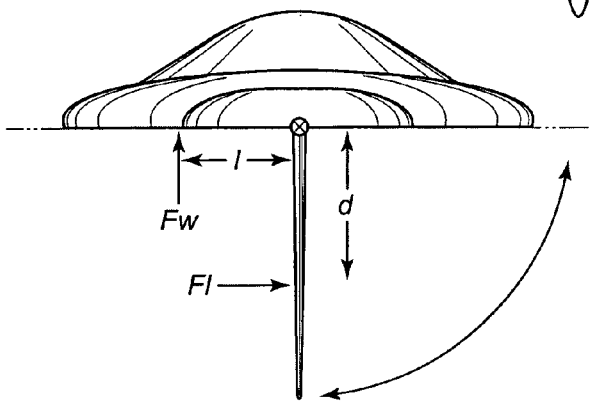
FIG. 12 is a diagrammatic illustration of the railing moment associated with the skeg as used in the present invention.

FIG. 12 is an illustration showing the railing moment associated with the fins of the present invention and the prior art. A further description of this railing moment will be provided hereinafter.

The present invention provides a formula-type board that is competitive at the low end of the wind range and also increased board speed. The prior art design is dominant in wind speeds between 5 to 30 knots. The present invention increases competitiveness in the 3 to 5 knot range, by planing in lighter wind and increasing sub-planing performance. The reduced drag has also increased competitiveness in the 10 to 30 knot range by increasing top end speed. The present invention increases sailboard performance at all points of sail where the skeg (or fin) has a significant angle of attack. This includes broad reach (down-wind), beam reach, and close reach (up-wind). The advantage of multiple skegs will be most significant on the close reach (up-wind). It will also enhance performance on beam reach and broad reach points of sail. The reduced fill drag also allows higher pointing angles when sailing upwind and faster board speed and deeper pointing angles when sailing off tile wind. The reduced drag will allow planing in less wind than current formula board designs. The retractable rear-mounted retractable fin allows the board to sail up-wind in very light wind. This enhances the ability to allow a safe return to shore if the wind should suddenly stop.

The increasing of the aspect ratio of the fin lowers the induced drag relative to a fin of lower aspect ratio with the same surface area, cross section, and planform. By increasing the aspect ratio from 7 to 10.5, the induced drag is reduced by 33.3 percent. The ratio of the induced drag coefficients is equal to the ratio of the aspect ratios. The total fin drag consists of induced drag and profile drag. Induced drag increases with angle of attack. Profile drag does not change with angle of attack. The reduction in total fin drag will vary with angle of attack from 0 drag reduction at 0 angle of attack to a maximum approaching 33 percent total drag reduction at a very large angle of attack where profile drag is small compared to induced drag. With the present invention, it is estimated that a reduction of total fin drag of approximately 12% is possible. The angle of attack of the fin varies with the point of sail from 1.62 degrees sailing off wind or downwind to 5.1 degrees while sailing upwind. The present invention replaces the single skeg with two or more skegs in parallel so that fin internal stress forces are reduced. The distance between the skegs must be made large enough to minimize the drag caused by interference between the two fins. By separating the fins by a gap of 1.12×1 (fin span), the interference drag will be less than five percent of the total induced drag. The dual high aspect fin ratios will provide the same lift at a lower angle of attack and with less drag than the single fin of lower aspect ratio, having the same surface area, planform, and cross section. At low wind speed or slow board speed, the fin operates at an increased angle of attack. The reduction in fin drag is greatest in this transition region between non-planing and planning. This allows the board to plane in lighter wind.

As the aspect ratio of the fin (of fins of equal surface area, the same planform and with the same cross section operating at the same lift) is increased, the same lift is generated at a reduced angle of attack. This may be used to reduce the fin area of the high aspect ratio fin such that it generates the same lift at the same angle of attack as the low aspect ratio fin. The smaller fin will have less drag at all points of sail due to the smaller surface area, but will have the same lift and angle of attack when sailing upwind. This has the advantage of increasing the fin efficiency at all points of sail.

The present invention provides a wider sailboard design with has the additional advantage of reducing board drag by reducing the wetted surface by supporting a portion of the total weight by aerodynamic lift. This reduces the amount of weight supported by hydrodynamic lift. The aerodynamic drag is much less than hydrodynamic drag because of the great difference in the density of air and water. The board is designed for aerodynamic stability. This is accomplished in the present invention by moving the aerodynamic center 30 to a position at or to the rear of the mast base 28. This is also accomplished by reducing the distance from the mast base 28 to the front 18 of the board by making the board shorter. This allows the pressure on the mast base 28 to keep the front 18 of the board from rising out of the water. If a sudden increase in angle of attack of the board due to chop causes a sudden increase in lift, the lift acts behind the mast base 28 so as to reduce the force of the board on the water. The dual fin design allows for a tunnel between the two fins to allow air to move underneath the board to increase aerodynamic lift and decrease the amount of planing surface required. The tunnel 96 and the wide separation from the surface of the water also adds stability. This provides higher top end board speed in lower wind conditions. The inside rails 100 and 102 of the tunnel 96 may be curved or sharp depending on performance objectives. Steps in the sides 100 and 102 also allow the planing surface to change with board speed. The sides 100 and 102 may have an angle of incidence with the fins 84 and 86. This angle of incidence helps to stabilize the fin maximum angle of attack. All boards have rockers such that only the rear planing surface is in contact with the water while planing.

The rear-mounted retractable fin 34 increases sub-planing performance by adding additional fin area required for sub-planing conditions. A rear mounted retractable fin may be mounted between the dual high aspect ratio skegs 14 and 16. The rear-mounted retractable fin 34 may be retracted while planing and extended when the wind drops to sub-planing levels. The retractable fin 34 has a cross section that can be optimized to create lift at very low Reynolds numbers. In sub-planing conditions, the interference between the retractable fin 34 and the dual high aspect ratio skegs 14 and 16 will not be a significant factor. In planing conditions, the retractable fin 34 may be retracted and will not cause interference between the skegs 14 and 16. The rear-mounted retractable fin 34 does not require adjustment of the mast base 28 while sailing because the mast base 28 and foot strap positioned on the top surface 22 of the sailboard 12 are in correct alignment with the rear-mount retractable fin and will not change significantly when sailing upwind and downwind. The rear-mount retractable fin 34 be retract in the forward position (as illustrated in FIG. 11) or in rear position (as shown in FIG. 10).

In the present invention, the skeg is vertically oriented. The lifting force of the water against the skeg acts at a point close to the center of the skeg area. The actual point is dependant upon the planform of the fin and the lift distribution along the fin. This force times the distance (d of the center of fin area) from the board causes a moment which tries to rotate the board about its centerline. This arrangement is illustrated in FIG. 12. The actual formula is $F1 \times d = Sw \times 1$ (with reference to the relationship shown in FIG. 12). This moment tends to rotate the board so that the windward rail is out of the water (i.e. railing moment). This moment must be countered by an equal and opposite moment from the force of the water against the board times the distance of the center of board planing surface area from the skeg. The use of more than one skeg reduces this railing moment which reduces the amount of force of the board against the water. This also reduces the drag of the board due to water.

The increasing of the aspect ratio of the skeg will increase the skeg internal stress forces. A high aspect ratio skeg has increased internal forces compared to a low aspect ratio skeg with the same lift. The longer skeg increases the moment arm from the base of the skeg to the point where the resultant lift force acts on the skeg. The increase of this moment arm increase the torque at the base of the skeg and also increases the skeg internal forces. The use of a single high aspect skeg provides more total drag reduction than dual skegs. A single skeg operates at a slightly higher Reynolds number, which increases efficiency. A single skeg does not have interference drag caused by interference between dual skegs. For small sail sizes, a single high aspect ratio skeg is the best design. The internal forces on the skegs are limited by the amount of force the skeg material can handle. Current formula skeg designs are operating close to the limits of currently available cost-effective materials. For large sail sizes, the internal stress forces on a single high aspect ratio skeg are close to the breaking point. The use of the two skegs in the present invention reduces the skeg internal stress levels. The force on each skeg is reduced by a factor of two. The moment arm is also reduced so that the skeg internal forces within the skeg are reduced by a factor greater than two for a skeg of the same thickness. By reducing skeg internal forces, the skeg can be made thinner if the same material is used, or a less expensive material may be used to make the skeg the same thickness.

The present specification defines three sailboard designs. The preferred embodiment of the hybrid sailboard design is illustrated in FIGS. 1–3. The formula sailboard design is illustrated in FIGS. 4 and 5. The tunnel hull sailboard embodiment is illustrated in FIGS. 6–9. All three of the designs of the present invention use dual high aspect ratio skegs. All three of these embodiments use aerodynamic lift to reduce board drag. All three are designed for aerodynamic stability and have the aerodynamic center located at the mast base or slightly to the rear of the mast base so as to provide aerodynamic stability. All of these boards have rockers so that only the rear planing surface is in contact with the water while planing.

The first embodiment of the present invention, as illustrated in FIGS. 1–3, is a robust design which performs well in all wind conditions and all points of sail. This embodiment utilizes the rear mounted retractable retractable fin 34 to improve sub-planing performance. The wing section of the retractable fin 34 may be optimized for low Reynolds number operation. The retractable fin 34 will usually be in the retracted position while planing.

The second embodiment of the present invention, as illustrated in FIGS. 4 and 5, has dual high aspect ratio skegs 56 and 58 and does not have a retractable fin. This embodiment will be lighter than the embodiment of FIGS. 1–3 so as to allow the embodiment of FIGS. 4 and 5 to plane in lighter wind conditions.

The tunnel hull sailboard apparatus 80 of the third embodiment FIGS. 6–9 is optimized for top end speed. This design will allows higher top end board speed in lower wind speeds. The tunnel hull 96 will achieve this top end speed with less wind velocity than current sailboard designs because of the reduced drag. Board drag is reduced to a minimum by allowing air to flow under the board 82 through the tunnel area 96. This increases aerodynamic lift and reduces wetted surface area. The dual planing surfaces of sides 100 and 102 are separated by the wide tunnel 96 and serve to increase stability at high speeds. The tunnel hull design of FIGS. 6–9 may be even shorter than the embodiment of FIGS. 4 and 5 for increased aerodynamic stability. The maximum speed of the sailboard 80 of FIGS. 6–9 will be higher that the apparatus 10 of FIGS. 1–3 or the apparatus 50 of FIGS. 4 and 5. The sides 100 and 102 of the tunnel 96 will help stabilize the angle of attack of the skegs 84 and 86.

In the present invention, the increasing of the aspect ratio of the skegs reduces the skeg drag with all other factors being constant. The increasing the aspect ratio of the skeg reduces the surface area required to generate the same lift at the same angle of attack as a skeg with a lower aspect ratio. The dual skegs reduce the skeg internal stress forces so as to allow the use of high aspect ratio skegs with larger sails. A small increase in the width at the end of the sailboard allows dual skegs to be used with only a small interference drag penalty. The rear-mounted retractable fin improves sub-planing performance by adding additional skeg surface area optimized for low Reynolds number operation. The drag of the board is reduced by supporting a portion of the total weight with aerodynamic lift and reducing the planing surface area required. The board length is reduced for aerodynamic stability. The tunnel between the dual skegs and the dual planing surface will add stability and increase aerodynamic lift.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a sailboard having a front and a rear, said sailboard having a top surface suitable for receiving human feet thereon and a bottom surface suitable for contacting a surface of a body of water;

a pair of skegs extending downwardly from said bottom surface generally adjacent said rear of said sailboard, said pair of skegs extending in a vertical orientation and parallel to a centerline of said sailboard, said pair of skegs having a distance therebetween that is equal to or greater than a span of said pair of skegs, said rear of said sailboard having a width greater than a average span of said pair of skegs; and a retractable fin positioned adjacent said rear of said sailboard, said retractable fin being mounted so as to move between a first position generally perpendicular to said sailboard and a second position aligned with said sailboard, said retractable fin retracted to a position extending outwardly of said rear of said sailboard when retracted to said second position.

2. The apparatus of claim 1, each of said pair of skegs having an aspect ratio of greater than 7.

3. The apparatus of claim 1, said sailboard having a receptacle formed in a bottom surface thereof, said retractable fin received in said receptacle when retracted to said second position.

4. The apparatus of claim 1, said sailboard having a mast base on said top surface thereof, said sailboard having an aerodynamic center located at or slightly rearwardly of said mast base.

5. The apparatus of claim 1, said sailboard having a tunnel area formed on said bottom surface adjacent said rear of said sailboard, said tunnel area positioned between said pair of skegs.

6. An apparatus comprising:

a sailboard having a front and a rear, said sailboard having a top surface suitable for receiving human feet thereon and a bottom surface suitable for contacting a surface of a body of water;

a pair of skegs extending downwardly from said bottom surface generally adjacent said rear of said sailboard, said pair of skegs extending in a vertical orientation and parallel to a centerline of said sailboard, said pair of skegs having a distance therebetween that is equal to or greater than a span of said pair of skegs, said rear of said sailboard having a width greater than a average span of said pair of skegs, said sailboard having a tunnel area formed on said bottom surface adjacent said rear of said sailboard, said tunnel area positioned between said pair of skegs, said tunnel area having sides tapering toward each other away from said rear of said sailboard, said sides defining an angle of incidence with said pair of skegs, said sides respectively spaced by an equal distance from said pair of skegs.

7. An apparatus comprising:

a sailboard having a front and rear, said sailboard having a top surface for receiving human feet thereon and a generally planar bottom surface suitable for contacting a surface of a body of water; and a tunnel area formed so as to extend inwardly into said bottom surface so as to be inset of said generally planar bottom surface, said tunnel area being adjacent said rear of said sailboard, said sailboard having a pair of skegs extending downwardly from said bottom surface said adjacent rear of said sailboard, said tunnel area positioned between said pair of skegs, said tunnel area having sides tapering toward each other away from said rear of said sailboard, said sides defining an angle of incidence with said pair of skegs, said sides respectively spaced by an equal distance from said pair of skegs.

8. The apparatus of claim 7, said sailboard having a mast base on said top surface thereof, said sailboard having an aerodynamic center located at or slightly rearwardly of said mast base.

* * * * *